United States Patent [19]

Simons

[11] Patent Number: 4,766,061

[45] Date of Patent: Aug. 23, 1988

[54] PHOTOGRAPHIC COUPLER DISPERSIONS

[75] Inventor: Michael J. Simons, Ruislip, United Kingdom

[73] Assignee: Eastman Kodak Company, Rochester, N.Y.

[21] Appl. No.: 40,006

[22] Filed: Apr. 20, 1987

Related U.S. Application Data

[63] Continuation of Ser. No. 800,260, Nov. 21, 1985, abandoned.

[51] Int. Cl.[4] ..... G03C 7/34; G03C 7/32

[52] U.S. Cl. ..... 430/546; 430/636; 252/332; 252/335; 252/336; 252/337; 252/338; 252/339

[58] Field of Search ..... 430/546, 636; 252/332, 252/333, 334, 335, 338, 339, 336, 337

[56] References Cited

U.S. PATENT DOCUMENTS

| | | | |
|---|---|---|---|
| 2,240,476 | 4/1941 | Simmons et al. | 95/7 |
| 3,676,141 | 7/1972 | Hara et al. | 430/377 |
| 3,912,517 | 10/1975 | Poucke et al. | 430/546 |
| 3,948,663 | 4/1976 | Shiba et al. | 430/546 |
| 3,963,499 | 6/1976 | Shiba et al. | 430/546 |
| 4,140,530 | 2/1979 | Trunley et al. | 96/67 |
| 4,146,399 | 3/1979 | Trunley et al. | 96/82 |
| 4,207,393 | 6/1980 | Snyder | 430/546 |
| 4,211,836 | 7/1980 | Yoneyama et al. | 430/449 |
| 4,385,110 | 5/1983 | Yoneyama et al. | 430/546 |

OTHER PUBLICATIONS

Research Disclosure, Dec. 1978, Item No. 17643.

*Primary Examiner*—Richard L. Schilling
*Attorney, Agent, or Firm*—Richard E. Knapp

[57] ABSTRACT

Loss in dark stability of a photographic silver halide element can be reduced by introducing into a dispersion comprising a dye-forming coupler for preparing such an element, a lipophilic anionic surfactant which comprises a sulphate or sulphonate group as the sole hydrophilic group and either a single aliphatic hydrocarbon group having at least 15 carbon atoms or two or more aliphatic hydrocarbon groups which together contain at least 17 carbon atoms. A second, less lipophilic, anionic surfactant can also be used in preparing the coupler dispersion.

11 Claims, No Drawings

PHOTOGRAPHIC COUPLER DISPERSIONS

This is a continuation of application Ser. No. 800,260, filed Nov. 21, 1985, now abandoned.

This invention relates to dispersions of couplers useful in silver halide color photographic materials.

It is well known to incorporate dye-forming couplers into photographic silver halide emulsion layers, or adjacent hydrophilic colloid layers, so that an imagewise distribution of oxidized color developing agent obtained by developing silver halide in the emulsion layer reacts with the coupler to form a dye image. In a color photographic material having red-, green- and blue-sensitive emulsion layers for providing, respectively, cyan, magenta and yellow dye images, it is necessary, in order to prevent contamination of each dye image with one or both of the other dyes, to ensure that the cyan, magenta and yellow couplers cannot diffuse from their positions in or near their respective emulsion layers. A common method of preventing coupler diffusion comprises providing the coupler with a water-insoluble "ballast" group and, before mixing the coupler with the relevant coating composition, dispersing the coupler as a uniform mixture with a water-insoluble high-boiling organic solvent, termed a coupler solvent or an "oil-former", in an aqueous gelatin solution. A surface-active agent is used to facilitate the dispersion process and to help stabilize the dispersion obtained.

A great variety of surface active agents have been made available and many types have been suggested for use in photographic materials. However, relatively hydrophobic surface ative agents have been suggested for this purpose much less frequently than surfactants of other classes. Instances concerning the preparation of dispersions of water-insoluble addenda, such as color couplers, are to be found in U.S. Pat. Nos. 3,676,141 and 3,912,517. Both of these patents propose use of an anionic surfactant containing a sulfonate or sulphate group and a hydrophobic radical of 8 to 30 carbon atoms with a non-ionic surface active compound for aiding dispersion by a conventional high-speed mixing process.

Many photographic coupler dispersions contain compounds with phenolic or naphtholic groups of which the acidity is enhanced by the presence of electron-withdrawing substituents in the ortho and/or para positions relative to the hydroxyl group. Well-known compounds of this kind are certain phenolic and naphtholic cyan dye-forming couplers, but couplers for producing dyes of other colors are known which contain such acidic groups. It has been found that the dark stability of the dyes formed by color development of photographic materials containing dispersions of phenolic or naphtholic compounds with enhanced acidity is not as good as is desirable. The present invention is based upon the discovery that the adverse effect on dye stability of the phenolic or naphtholic compound can be mitigated to a useful extent by the use of certain lipophilic anionic surfactants in preparing the relevant dispersions. Additional anionic surfactants of more conventional type can be used to aid the dispersion process but non-ionic surfactants have been found to reduce the beneficial effect of the lipophilic surfactant and so are excluded.

In accord with the present invention a photographic element is provided comprising a support bearing at least one hydrophilic layer, preferably at least one hydrophilic photographic silver halide emulsion layer and/or at least one hydrophilic layer that is not photosensitive. The hydrophilic layer comprises at least one photographic coupler and an oil-former in the presence of an anionic surfactant. In this photographic element according to the invention A. at least one of the photographic coupler and oil-former comprise a phenolic or naphtholic moiety having a least one electron-withdrawing group at a position ortho or para to the phenolic hydroxyl group; and B. the anionic surfactant is a lipophilic anionic surfactant that comprises a sulfate or sulfonate group as the sole hydrophilic group and comprises either a single aliphatic hydrocarbon group having at least 15 carbon atoms or at least two aliphatic hydrocarbon groups that together contain at least 17 carbon atoms.

The photographic element of the invention contains no non-ionic surfactant.

Another embodiment of the invention comprises a method of making a photographic coupler dispersion by dispersing a mixture containing the coupler and an oil-former in an aqueous hydrophilic colloid solution in the presence of an anionic surfactant, the coupler and/or the oil-former comprising a phenolic or naphtholic moiety of which the acidity is enhanced by the presence of at least one electron-withdrawing group at a position ortho or para to the phenolic hydroxyl group, wherein there is added at any stage a lipophilic anionic surfactant which comprises a sulphate or sulfonate group as the sole hydrophilic group and either a single aliphatic hydrocarbon group having at least 15 carbon atoms or two or more aliphatic hydrocarbon groups which together contain at least 17 carbon atoms, but wherein no non-ionic surfactant is used.

The anionic surfactant defined above is referred to herein as the lipophilic anionic surfactant.

The coupler dispersions according to the invention contain in the oily, dispersed, phase, at least one compound comprising a phenolic or naphtholic moiety, each such compound having at least one electron-withdrawing substituent in a position ortho or para to the phenolic hydroxyl group which enhances the acidity of that group. As is well known, many substituents have an electron-withdrawing effect and the following are listed as examples:

| | |
|---|---|
| cyano | $-COOR^1$ |
| nitro | $-CONR^1R^2$ |
| halogen | $-SO_2NR^1R^2$ |
| (especially F, Cl or Br) | $-SO_2R$ |
| $-CCl_3$ or $-C_nF_{2n+1}$ | $-SO_3M$ |
| $-COR$ | $-OSO_3M$ |
| $-OCOR$ | $-N{=}N-R^3$ |

wherein R is an alkyl or aryl group, each of $R^1$ and $R^2$ is hydrogen or an alkyl or aryl group, $R^3$ is an aryl or heterocyclic group and M is a cation, any group R, $R^1$, $R^2$ and $R^3$ possibly being itself substituted with such substituents as alkyl, alkoxy, aryl, aryloxy, halogen, nitro, and carboxylic acid, ester and amide groups. A suitable substituent for the phenolic or naphtholic moiety has a Hammett p-Substituent Constant greater than zero: See, for instance, the article by Exner in the book "Advances in Linear Free Energy Relationships", edited by Chapman and Shorter, Plenum Press (London) 1972.

The compound comprising the acidic phenolic, or naphtholic, moiety can be the coupler itself, in which case it can be a substituted member of one of the various classes of cyan dye-forming coupler. Such couplers are described in, for example:

| | | |
|---|---|---|
| U.K. Patent | 562,205 | 825,311 |
| | 586,211 | 843,497 |
| | 627,814 | 1,077,873 |
| | 649,660 | 1,165,563 |
| | 737,104 | 1,377,233 |
| | 797,141 | 1,541,075 |

the disclosures of which are incorporated herein by reference.

Alternatively the compound comprising the acidic phenolic or naphtholic moiety can be a coupler giving, on color development, a magenta or yellow dye, coupling taking place preferentially at a pyrazolone or active methylene coupling position rather than at a position para to the hydroxyl group of the phenolic or naphtholic moiety. Couplers of this kind are described in, for instance, U.K. Patent Specification No. 1,474,128.

Another alternative is for the compound comprising the acidic phenolic or naphtholic moiety to be a coupler solvent, in which case the coupler itself need not contain such a moiety. Coupler solvents having acidic phenolic or naphtholic moieties are described in, for instance, U.S. Pat. Nos. 4,207,393 and 4,228,235.

Any coupler solvents known to be useful in photographic materials are useful as the oil-former in a dispersion of the invention. Useful solvents are inert high-boiling liquids or low-melting solids, well-known examples being dibutyl phthalate and tricresyl phosphate. Numerous other coupler solvents are described in U.K. Patent Specification No. 541,589.

A coupler dispersion of the invention contains an anionic surfactant which comprises, as the sole hydrophilic group, a group of formula $—SO_3M$ or $—OSO_3M$ (where M is any convenient cation, such as sodium or potassium cations) and either a single aliphatic hydrocarbon group having at least 15 carbon atoms or two or more aliphatic hydrocarbon groups which together contain at least 17 carbon atoms. The aliphatic hydrocarbon group or groups can contain unsaturation and the surfactant molecule can contain such non-hydrophilic features as ether, amide or sulfonamide linkages and ester groups. Classes of surfactant having at least some members in accordance with these requirements include:

(i) alkane sulfonates,
(ii) alcohol sulphates,
(iii) ether alcohol sulphates,
(iv) sulphated polyol esters,
(v) sulphated alkanolamides,
(vi) sulphated amides
(vii) sulphated esters
(viii) slfonated esters,
(ix) alkylarylsulfonates,
(x) olefin sulfonates,
(xi) sulfopolycarboxylic esters,
(xii) sulfonalkylesters of fatty acids,
(xiii) sulfoalkylamides of fatty acids.
(xiv) petroleum sulfonates as described in copending U.S. Ser. No. 800,199, now U.S. Pat. No. 4,624,903 and related to U.S. Pat. No. 4,716,099, filed concurrently herewith, of Simons, based on U.K. application No. 8428678 filed Nov. 23, 1984.

Preferred surfactants from these classes are alkane sulfonates (class i) of formula: $R'SO_3M$ and alkylphenol sulfonates (class ix) of formula:

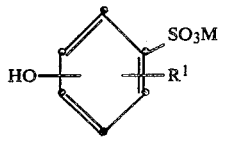

wherein $R^1$ is a straight chain alkyl or alkenyl group of at least 15 carbon atoms, and dialkylsulfosuccinates (class xi) of formula:

$$\begin{array}{c} CH_2COOC_mH_{2m+1} \\ | \\ MO_3S—CHCOOC_nH_{2n+1} \end{array}$$

wherein m+n is at least 17, m and n being the same or different. M in the above formulae is a hydrogen ion, an alkali metal ion or any other useful cation.

Optionally, a mixture of two or more compounds can be used. Thus two or more couplers, coupler solvents or lipophilic surfactants can be employed, it being necessary for only one of these compounds to comprise an acidic phenolic or naphtholic moiety.

The dispersing agent used in a method of the invention can also include a second, and less lipophilic, anionic surfactant. This can be from the classes (i) to (xiii) listed above, the reduced lipophilic character being achieved through the presence of fewer carbon atoms in the aliphatic hydrocarbon group or groups present or through the presence of more than one hydrophilic group, any additional group being, for instance, an hydroxyl, or a carboxylic acid or salt, group. Thus, a second anionic surfactant can contain a single group $—SO_3M$ or $—OSO_3M$ and either a single aliphatic hydrocarbon group having fewer than 15 carbon atoms or two or more aliphatic hydrocarbon groups which together contain fewer than 17 carbon atoms. Alternatively, a second anionic surfactant can be of some other class such as a sulphated monoglyceride, a sulphated fat or oil having a free carboxyl group, an $\alpha$-sulfocarboxylic acid, an alkyl glyceryl ether sulfonate or an N-acylated-amino acid.

The coupler-coupler solvent solution or mixture is dispersed, with the aid of a surfactant or surfactant mixture, in an aqueous hydrophilic colloid solution. The colloid is preferably gelatin or a simple derivative such as phthalated gelatin.

This dispersion step in a method of the invention can be effected conventionally using any high-speed mixing device. A water-miscible or volatile water-immiscible "auxiliary solvent" can be present, being removed by washing with water from the set dispersion or when volatile, by evaporation under reduced pressure. Auxiliary solvents and their use are described in, for example, U.S. Pat. No. 2,801,171.

In carrying out a method of the invention, the compound comprising a phenolic or naphtholic moiety of enhanced acidity, or mixture of such compounds, preferably constitutes at least 5% by weight of the oil phase (i.e. the coupler, water-immiscible solvent and lipophilic anionic surfactant) and the lipophilic anionic surfactant preferably constitutes at least 1% by weight of the oil phase. Relative to the weight of the coupler, the weight of lipophilic surfactant is usually present at a concentration of from 1 to 100% by weight, the preferred range being 3 to 20%.

A coupler dispersion made by a method of the invention is employed conventionally in the manufacture of incorporated-coupler silver halide color photographic materials, both negative and positive materials. Numerous references to patent specifications and other publications relating to silver halide photographic materials, including color materials and their processing, are given in *Research Disclosure,* December 1978, Item 17643 (see especially sections VII, XI, XIV and XIX) published by Kenneth Mason Publications, Ltd., The Old Harbourmaster's, 8 North Street, Emsworth, Hampshire P010 7DD, ENGLAND. Thus, the dispersion is mixed with the appropriate coating composition, usually a gelatino-silver halide photographic emulsion, prior to coating.

The invention is illustrated by the following examples.

EXAMPLE 1

Dispersions of coupler I having the structure:

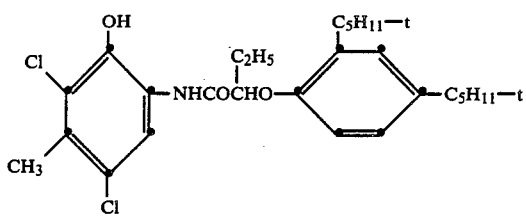

were preprared by dissolving the coupler, 0.60 g, in di-n-butyl phthalate, 0.60 g, and mechanically dispersing the resulting oily solution in 9.4 ml of 6.6% w/v gelatin solution to which had been added surfactant as in Table 1. The result was an oil-in-water dispersion having an average droplet diameter of less than 1 μm.

Photographic coatings were prepared by combining together, under safelight conditions, 1.5 g of coupler dispersion, 1.5 g of 12½% w/v aqueous gelatin solution, 0.20 ml of photographic paper type silver chlorobromide emulsion (approximately 1.0M in silver halide) and 5.5 ml water. 5% w/v chromic sulphate solution, 0.30 ml, was added immediately prior to coating on photographic film base at a wet thickness of approximately 0.1 mm.

Portions of dried coating were exposed to room light for 5 s and then developed for 210 s in a p-phenylenediamine developer (KODAK-"Ektaprint 2", trademark of Eastman Kodak Company, U.S.A.) at 31° C., bleach-fixed for 120 s in a bleach-fix solution (KODAK "Ektaprint", trademark of Eastman Kodak Company, U.S.A.), washed for 30 minutes in running water, and dried.

The resulting cyan dye density of each sample was measured with a transmission densitometer through a red filter. The samples were then incubated in an oven at 60° C. and 70% relative humidity and the dye density measured from time to time. The initial optical density (Di) and the percentage density loss at the various times are recorded in Table 1.

TABLE 1

| Surfactant added (sodium salt) | Di | % density loss at stated time/days 7 | 14 | 28 | 42 |
|---|---|---|---|---|---|
| Control: | | | | | |
| tri-isopropylnaphthalene sulfonate | | | | | |
| 0.03 g | 1.56 | 5.8 | 12 | 26 | 37 |
| 0.06 g | 1.85 | 6.3 | 12 | 26 | 39 |
| 0.12 g | 1.92 | 7.3 | 15 | 30 | 43 |
| Invention: | | | | | |
| bis (tridecyl) sulfosuccinate | | | | | |
| 0.04 g | 1.37 | 1.5 | 5.1 | 11 | 18 |
| 0.08 g | 1.57 | 0.6 | 4.0 | 10 | 18 |
| Pentadecylphenolsufonate | | | | | |
| 0.06 g | 1.26 | 2.4 | 5.5 | 12 | 20 |
| 0.12 g | 1.70 | 1.2 | 4.1 | 11 | 19 |

It will be seen that the image dyes from dispersions made according to the invention faded at less than half the rate of the dyes from the prior art dispersions (sodium tri-isopropylnaphthalene sulfonate peptized) in this accelerated dark keeping test.

EXAMPLE 2

This example illustrates the use of a combination of hydrophilic and hydrophobic surfactants according to the the invention.

A coupler dispersion was prepared by dissolving coupler I, 5.0 g, in di-n-butyl phthalate, 2.8 g together with 2-(2-butoxyethoxy)ethyl acetate, 0.4 g, and mechanically dispersing the resulting oily solution in 11.5% w/v gelatin solution, 42 g, containing sodium triisopropylnaphthalene sulfonate, 0.18 g. Portions of 10 g were withdrawn, and 10% w/v solutions of sodium bis(tridecyl)sulfosuccinate in 1:2 methanol:water were added as in Table 2 and mechanically dispersed into the dispersion.

Photographic coatings were prepared by combining together, under safelight conditions, 1.0 g of coupler dispersion, 1.5 g of 12½% w/v aqueous gelatin solution, 0.20 ml of photographic paper type silver chlorobromide emulsion (approximately 1.0M in silver halide), and 6.0 ml water. 5% w/v chromic sulphate solution, 0.30 ml, was added immediately prior to coating on photographic film base at a wet thickness of approximately 0.1 mm.

Portions of dried coating were exposed, processed and tested as in Example 1: the results are given in Table 2. A low humidity accelerated keeping test was also carried out by placing processed strips in an oven at 77° C. with no added humidity, and measuring the dye density at intervals as before. These results are given in Table 3.

TABLE 2

60° C. 70% R. H. results

| 10% sodium bis (tridecyl) sulfosuccinate solution added | Di | % density loss at stated time 7 | 14 | 28 days |
|---|---|---|---|---|
| None | 1.71 | 8.2 | 19 | 36 |
| 0.1 ml | 1.80 | 6.1 | 12 | 26 |
| 0.2 | 1.52 | 4.6 | 10 | 23 |
| 0.4 | 1.08 | 1.9 | 6.5 | 18 |
| 0.8 | 1.95 | *3.5 | 0 | 9.7 |

*increase

TABLE 3

| 77° C. low humidity results | | | | |
|---|---|---|---|---|
| 10% sodium bis (tridecyl) sulfosuccinate solution added | Di | % density loss at stated time | | |
| | | 3 | 7 | 16 days |
| None | 1.78 | 13 | 30 | 55 |
| 0.1 ml | 1.79 | 9.5 | 23 | 49 |
| 0.2 | 1.48 | 10 | 22 | 47 |
| 0.4 | 1.82 | 6.6 | 17 | 43 |
| 0.8 | 1.91 | 4.7 | 14 | 39 |

EXAMPLE 3

This example illustrates another combination of hydrophilic and hydrophobic surfactants according to the invention.

Coupler dispersions were prepared by dissolving together 1.0 g of coupler I, 0.6 g of tricresyl phosphate, and 0.10 g of sodium bis(tridecyl)sulfosuccinate, and mechanically dispersing the resulting oily solution into 5.0 g of a 12½% w/v aqueous gelatin solution mixed with 3.0 ml water and 10% w/v aqueous sodium dioctyl sulfosuccinate as stated in Table 4. The dispersion prepared for Example 2 was used for this control.

Coatings were prepared as in Example 2, except that 0.9 ml of dispersion and 6.1 ml of water were added. Testing was as in Example 2, and results are given in Tables 4 and 5.

TABLE 4

| 60° C. 70% R. H. results | | | |
|---|---|---|---|
| 10% sodium dioctylsulfosuccinate solution added to coupler dispersion | Di | % density loss at stated time | |
| | | 6 | 14 days |
| (control) None (dispersion as Example 2) | 2.62 | 5.0 | 13 |
| 0.60 ml | 1.49 | 2.0 | 5.4 |
| 0.75 ml | 2.17 | 1.4 | 4.6 |
| 1.0 ml | 2.63 | 1.2 | 1.9 |

TABLE 5

| 77° C. low humidity results | | | |
|---|---|---|---|
| 10% sodium dioctylsulfosuccinate solution added to coupler dispersion | Di | % density loss at stated time | |
| | | 3 | 6 days |
| (control) None | 2.55 | 5.9 | 15 |
| 0.60 ml | 1.50 | 2.0 | 6.0 |
| 0.75 ml | 2.18 | 2.7 | 7.8 |
| 1.0 ml | 2.61 | 1.1 | 4.6 |

EXAMPLE 4

A dispersion of coupler II having the formula:

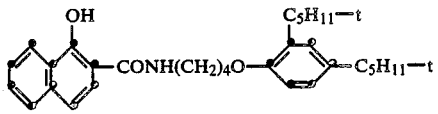

was prepared by dissolving 3.5 g of coupler into a mixture of 2.0 g of di-n-butyl phthalate and 8.0 g of 2-(2-butoxyethoxy)ethyl acetate, and mechanically dispersing the resulting oily solution into 40 g of 9.0% w/v gelatin solution to which had been added 0.5 g of sodium tri-iso-propylnaphthalene sulfonate. The dispersion was then cooled, and when set was cut into small cubes of approximately 0.5 cm edge. The chopped dispersion was washed for 5 hours in chilled (5° C.) demineralized water which was maintained at approximately pH 5.5 by addition of a small quantity of propionic acid. The washed dispersion was melted at 40° C. and to a 5.0 g portion was added 0.2 g of a 70% w/w solution of sodium bis(tridecyl)sulfosuccinate ("Aerosol TR 70"—trademark—supplied by Cyanamid of Great Britain Limited). This solution was mechanically dispersed into the dispersion sample.

Coatings were prepared as in Example 2, except that 1.3 g of dispersion and 4.9 ml of water were used for each coating. Testing was carried out as in Example 2, and the results are shown in Table 6.

TABLE 6

| Condition A: 60° C., 70% R. H. Condition B: 77° C., low humidity | | | | |
|---|---|---|---|---|
| Fading Condition | 70% sodium bis (tridecyl) sulfosuccinate added | Di | % density loss after | |
| | | | 7 | 14 days |
| A | — | 1.90 | 1.6 | 4.2 |
| A | 0.1 g | 2.10 | 0 | 1.9 |
| B | — | 1.88 | 2.1 | 6.4 |
| B | 0.1 g | 2.15 | 0.5 | 2.3 |

EXAMPLE 5

This is a comparative example in which no acidic phenol or naphthol was present.

Dispersions of coupler were prepared by dissolving coupler, 1.5 g, in di-n-butyl phthalate, 0.9 g, and ethyl acetate, 0.9 g, and mechanically dispersing the resultant solution in 15 g of 9.2% w/w gelatin to which had been added 10% sodium tri-isopropyl naphthalene sulfonate, 0.6 ml.

1.0 g portions of dispersion were taken and 0.3 ml of water or of a solution of hydrophobic surfactant added (see Table 7) and the mixture held for 20 minutes at 40° C.

Photographic coatings were prepared by combining together, under safelight conditions, the treated portion of coupler dispersion, 1.5 g of 12½% w/v aqueous gelatin solution, 0.25 ml of photographic paper type silver chlorobromide emulsion (approximately 1.0M in silver halide) and 5.7 ml water.

5% w/v chromic sulphate solution, 0.30 ml, was added immediately prior to coating on photographic film base at a wet thickness of approximately 0.1 mm.

Portions of dried coating were exposed to room light for 5 s and then developed for 210 s at 31° C., bleach-fixed for 60 s, washed for 10 minutes in running water, and dried. The processing solutions used were as for Example 1.

The resulting dye density of each sample was measured with a transmission densitometer through an appropriate filter: green for a magenta image, blue for a yellow image. The samples were then incubated in the dark in an oven at 60° C. and 70% relative humidity for four weeks and the dye densities again measured. The percentage fades which had occurred are listed in Table 7. It will be seen that the presence of the surfactants did not improve the dark stability.

TABLE 7

| Coupler | Addition | Image Hue | Original Density | % Fade (4 weeks) |
|---|---|---|---|---|
| III | Water | Yellow | 1.11 | 0.0 |
| | A | | 1.14 | 0.6 |
| IV | Water | Magenta | 1.63 | 0.6 |

TABLE 7-continued

| Coupler | Addition | Image Hue | Original Density | % Fade (4 weeks) |
|---|---|---|---|---|
| | A | | 1.65 | 1.2 |
| V | Water | Magenta | 1.80 | 2.8 |
| | A | | 2.06 | 9.7 |

Notes:
Addition: 0.3 ml of water or A:7% Aerosol TR70 (Sodium bis-tridecyl sulfo-succinate)
(Aerosol TR70 is a trademark for a surfactant manufactured by the American Cyanamid Company, U.S.A.)

Couplers III to V had the structures:

Coupler III

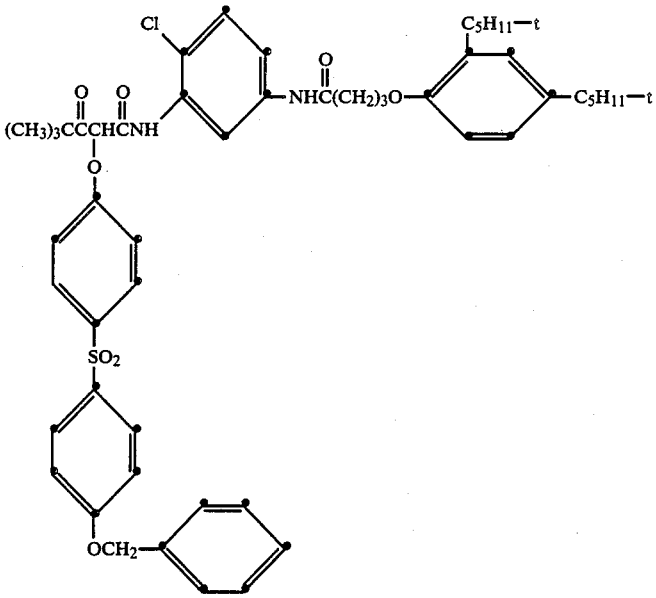

Coupler IV

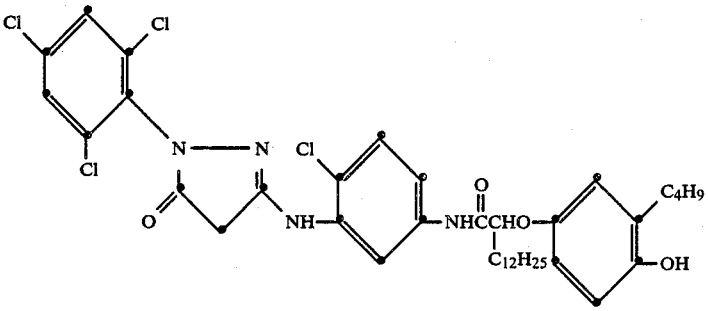

Coupler V

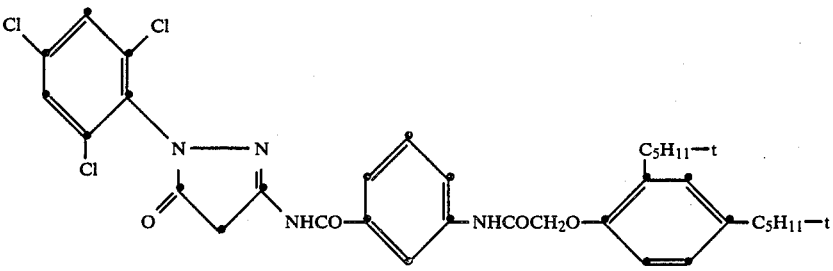

EXAMPLE 6

This Example illustrates the use of the surfactants of the invention when coupler IV was dispersed in the presence of an acidic phenol coupler solvent.

Coupler IV, 1.0 g; n-dodecyl-p-hydroxybenzoate, 0.33 g; n-octyl-p-hydroxy-benzoate, 0.33 g/; and N,N-diethyl lauramide, 0.33 g, were melted to form an oily solution. This solution was mechanically dispersed into 7.6 g of 10.5% w/w gelatin solution, to which had been added 0.8 g of 10% w/w sodium dioctyl sulfosuccinate aqueous solution and other surfactants as stated in Table 9.

Photographic coatings were prepared by combining together under safelight conditions, 0.8 g of coupler dispersion, 0.25 g of silver chlorobromide photographic paper emulsion (approximately 1.0M in silver halide, 1.0 g of 12% w/w gelatin aqueous solution, and 6.6 ml of water. 5% w/v chromic sulphate solution, 0.30 ml, was added immediately prior to coating on photographic film base at a wet thickness of approximately 0.10 mm.

Portions of dried coating were exposed, processed and tested as in Example 5: results are given in Table 9. It will be seen that in this and in the previous Example the presence of the surfactant of the Invention improved the dark stability of the dye in the presence of the acidic phenols.

TABLE 8

| Coating | Surfactant Added | Original Density | % Fade in 12 weeks |
|---|---|---|---|
| | — | 1.24 | 6.5 |
| A, | 0.10 g | 1.29 | 3.1 |
| A, | 0.20 g | 1.26 | 2.4 |
| A, | 0.30 g | 1.72 | −1.2 (density increase) |

Note: surfactant A, 70% sodium bis-tridecyl sulfo-succinate

EXAMPLE 7

The coupler used in this Example had an acidic phenol leaving group. The results show how the dark stability of the image dye was most diminished in areas of low image density, where most acidic phenol remained. The stabilizing effect of the surfactants of the invention is illustrated: the effects varied with the humidity at which the accelerated dark fading was carried out.

A coupler dispersion and coatings were prepared as in Example 5, except that coupler VI was used. The coatings were exposed to a photographic step wedge and processed as in Example 5. The image densities of the various steps of the image were measured (blue filter). The strips were incubated either for 60 days at 60° C., 70% RH or for 28 days at 77° C., low RH. Results are given in Table 10: coating A had 0.3 ml water added, B had 0.3 ml 7% Aerosol TR70, as in Example 5.

Coupler VI:

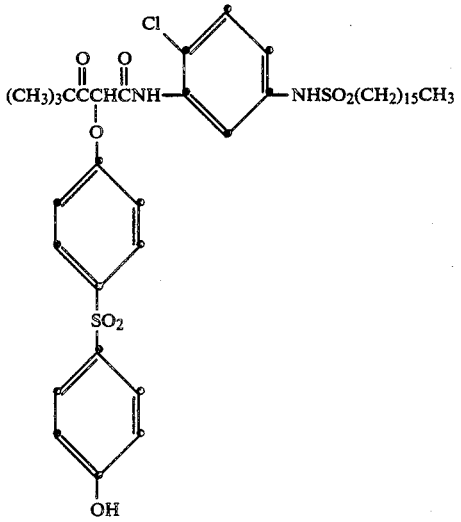

TABLE 9

| Coating | 60 Days 60° C. 70% RH Initial Step Density | % Fade | 28 Days 77° C., Low RH Initial Step Density | % Fade |
|---|---|---|---|---|
| A | 0.35 | 26 | 0.39 | 38 |
| | 0.67 | 33 | 0.71 | 37 |
| | 0.97 | 28 | 1.02 | 34 |
| | 1.37 | 20 | 1.42 | 23 |
| | 1.76 | 11 | 1.82 | 12 |
| | 1.90 | 7 | 1.98 | 3 |
| B | 0.47 | 13 | 0.46 | 11 |
| | 0.78 | 15 | 0.76 | 9 |
| | 1.10 | 18 | 1.08 | 8 |
| | 1.52 | 18 | 1.49 | 6 |
| | 1.90 | 17 | 1.87 | 4 |
| | 2.02 | 14 | 1.95 | 2 |

EXAMPLE 8

Coatings were prepared and tested as in Example 5, using the acidic phenol cyan coupler VII. The surfactant additions were different: these and other results are given in Table 10.

TABLE 10

| Surfactant Addition | Original (red) Density | % Fade (4 weeks) |
|---|---|---|
| 0.3 ml water | 1.64 | 4.3 |
| 0.1 ml A | 1.24 | 1.6 |
| 0.2 ml A | 1.01 | 3.0 |
| 0.1 ml C | 1.09 | 0.9 |
| 0.1 ml D | 1.69 | 0.6 |

Note:
Surfactant solution.
A, 7% sodium bis-tridecyl sulfosuccinate.
C, 10% Hostapur SAS 60 (Trademark). (This is a mixture of $C_{13}$–$C_{18}$ sodium alkyl sulfonates).
D, 10% sodium pentadecyl phenol sulfonate.

Coupler VII

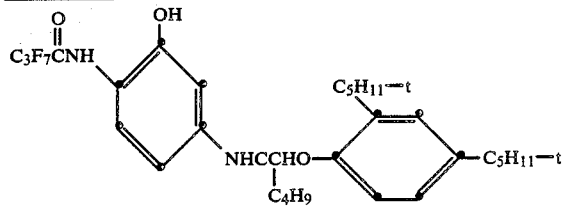

EXAMPLE 9

Multilayer coatings were made on a paper support according to the following summary. The numbers in parenthesis are coverages expressed as mg/m². In the case of the silver halide in the emulsion layers, the coverages relate to the silver present.

Layer 6—Gelatin (1076)

Layer 5—Gelatin (1679), red-sensitive silverchlorobromide emulsion (281), cyan coupler (1076) and hydrophobic surfactant (301), (See Table II)

Layer 4—Gelatin (1313), UV-absorber (861), dioctylhydroquinone (58)

Layer 3—Gelatin (1851), green-sensitive silver chlorobromide emulsion (418), magenta coupler IV (522)

Layer 2—Gelatin (753), dioctylhydroquinone (54)

Layer 1—Gelatin (1690), blue-sensitive silver chlorobromide emulsion (403), yellow coupler III (990), gelatin hardener Support—Electron-bombarded polyethylene coated paper.

The couplers were incorporated in the layers as dispersions, being mixed with di-n-butyl phthalate (one half the coupler weight in the case of the cyan and magenta couplers and one quarter the coupler weight in the case of the yellow coupler) and dispersed in aqueous gelatin solutions with the aid of sodium tri-isopropyl naphthalene sulfonate. The UV absorber in layer 4 comprised a mixture of 84.1% (by weight) of 2-(2-hydroxy-3,5-di-tert-pentylphenyl)benzotriazole, 15% 2-(2-hydroxy-3-tert-butyl-5-methylphenyl)benzotriazole and 0.9% dioctylhydroquinone dispersed in 2-(2-butoxyethoxy)ethyl acetate. The gelatin hardener in layer 1 was bis(vinylsulfonylmethyl)ether and was added in an amount equal to 1.75% of the total weight of the gelatin in the multilayer coating.

Four different multilayer coatings were made using two different couplers, each coated with or without the lipophilic anionic surfactant sodium bis(tridecyl)sulfosuccinate. The couplers were numbers I and VIII defined by the formula:

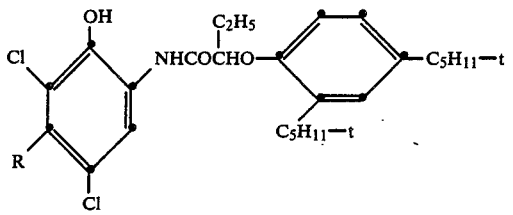

Coupler I: R = $CH_3$
Coupler VIII: R = $C_2H_5$

Samples of the four coatings were exposed, processed as described in Example 1 and then used for determining the stability of the cyan dye image under incubation test conditions. In all the tests the loss in red-light reflection density of an image having an initial value of 1.7 was measured as a function of the incubation time. Two different test conditions were used, 77° C. and 15% relative humidity for the two week tests and 60° C. and 70% humidity for 16 week tests.

The results obtained are given in Table 11.

TABLE 11

| Coupler | Lipophilic Surfactant ($mg/m^2$) | % density loss after (weeks incubation): 4 | 6 | 8 | 12 | 16 | 2 |
|---|---|---|---|---|---|---|---|
| I | 0 | 17 | 32 | 35 | 48 | 55 | 28 |
| II | 301 | 10 | 19 | 24 | 36 | 45 | 25 |
| VIII | 0 | 3 | 4 | 4 | 8 | 9 | 4 |
| VIII | 301 | 0 | 2 | 1 | 5 | 4 | 2 |

These show that the lipophilic surfactant reduced the density loss of both cyan image dyes for both incubation test conditions. The stability of the image dyes to light exposure was unimpaired by the presence of the lipophilic surfactant.

The invention has been described in detail with particular reference to preferred embodiments thereof, but it will be understood that variations and modifications can be effected within the spirit and scope of the invention.

What is claimed is:

1. In a photographic silver halide element comprising a support bearing at least one hydrophilic layer comprising a photographic coupler dispersion comprising at least one photographic coupler and an oil-former in the presence of an anionic surfactant, the improvement wherein A. at least one of the photographic coupler and oil-former comprises a phenolic or naphtholic moiety having at least one electron-withdrawing group at a position ortho or para to the phenolic hydroxyl group; and B. the anionic surfactant is a lipophilic anionic surfactant which is a compound represented by the formula:

$$\begin{array}{l} \quad\quad\quad CH_2COOC_mH_{2m+1} \\ \quad\quad\quad\quad | \\ MO_3S-CHCOOC_nH_{2n+1} \end{array}$$

wherein the sum of m plus n is at least 17; m and n are the same or different numbers; and, M is hydrogen or a cation, and containing no non-ionic surfactant.

2. A photographic silver halide element as in claim 1 wherein the lipophilic anionic surfactant is bis(tridecyl)-sulfosuccinate.

3. A photographic silver halide element as in claim 1 comprising a second lipophilic anionic surfactant comprising a single aliphatic hydrocarbon group having less than 15 carbon atoms or at least two aliphatic hydrocarbon groups which together contain less than 17 carbon atoms.

4. A photographic silver halide element as in claim 1 wherein the coupler is a phenolic or naphtholic cyan dye-forming coupler.

5. A photographic element as in claim 1 comprising a second anionic surfactant.

6. A photographic silver halide element as in claim 1 comprising a second anionic surfactant which is a compound selected from the group consisting of sulfated monoglycerides, sulfated fats or oils having a free carboxyl group, α-sulfocarboxylic acids, alkyl glyceryl ether sulfonates, and N-acylated amino acids.

7. A method of making a photographic coupler dispersion by dispersing a mixture containing the coupler and an oil-former in an aqueous hydrophilic colloid solution in the presence of an anionic surfactant, at least one of the coupler and the oil-former comprising a phenolic or naphtholic moiety of which the acidity is enhanced by the presence of at least one electron-withdrawing group at a position ortho or para to the phenolic hydroxyl group, wherein there is added at any stage a lipophilic anionic surfactant which is a compound represented by the formula:

$$\begin{array}{l} \quad\quad\quad CH_2COOC_mH_{2m+1} \\ \quad\quad\quad\quad | \\ MO_3S-CHCOOC_nH_{2n+1} \end{array}$$

wherein the sum of m plus n is at least 17; m and n are the same or different numbers; and, M is hydrogen or a cation, but wherein no non-ionic surfactant is used.

8. A method according to claim 7 wherein the lipophilic anionic surfactant is added before the dispersion step.

9. A method according to claim 7 wherein the coupler is a phenolic or naphtholic cyan dye-forming coupler.

10. A method according to claim 7 wherein the coupler solvent comprises a phenolic or naphtholic moiety of enhanced acidity.

11. A method according to claim 7 wherein the total lipophilic surfactant constitutes at least 1% by weight of the dispersed substances.

* * * * *